US005954006A

United States Patent [19]

Nishikawa et al.

[11] Patent Number: 5,954,006

[45] Date of Patent: Sep. 21, 1999

[54] APPARATUS FOR FOLDING A CLOTH CONVEYED CONTINUOUSLY ALONG A CONVEYING SURFACE OF A CONVEYING DEVICE

[75] Inventors: Masahiko Nishikawa; Hiroyuki Okamoto, both of Osaka, Japan

[73] Assignee: Pegasus Sewing Machine Mfg. Co., Ltd., Osaka, Japan

[21] Appl. No.: 09/154,829

[22] Filed: Sep. 17, 1998

[30] Foreign Application Priority Data

Sep. 22, 1997 [JP] Japan ..... 9-257098

[51] Int. Cl.[6] ..... D05B 21/00; D05B 33/02; D05B 35/00

[52] U.S. Cl. ..... 112/470.16; 112/147; 112/304; 112/DIG. 2; 270/32; 493/419; 493/450; 493/937

[58] Field of Search ..... 112/470.16, 470.01, 112/470.02, 470.03, 470.07, 141, 143, 147, 304, 306, 475.02, 475.03, 475.04, DIG. 2, 475.06

[56] References Cited

U.S. PATENT DOCUMENTS 5,258,501 11/1993 Suzuki et al. ..... 112/470.16 X
5,363,784 11/1994 Adamski, Jr. et al. ..... 112/147 X
5,865,135 2/1999 Price et al. ..... 112/475.06

*Primary Examiner*—Peter Nerbun
*Attorney, Agent, or Firm*—Jones, Tullar & Cooper, P.C.

[57] ABSTRACT

The apparatus of the invention is applied to a case of folding, for example, the sleeve cloth of short-sleeved T-shirt in half while conveying. A holding device grips the leading end of the cloth conveyed on a conveying surface of narrow conveyor belts, lifts the gripped leading end of the cloth from the conveying surface, and holds it above the conveying surface temporarily. A cloth stopping device stops conveying of the front side portion of the conveyed cloth on the conveying surface at a position of an upstream side in the conveying direction from the holding device. When cloths are put on the conveying surface by overlaying mutually in part, a space is formed between the preceding cloth and succeeding cloth by the cloth stopping device, so that the leading end of the cloth is gripped and lifted by the holding device.

3 Claims, 8 Drawing Sheets

APPARATUS FOR FOLDING A CLOTH CONVEYED CONTINUOUSLY ALONG A CONVEYING SURFACE OF A CONVEYING DEVICE

BACKGROUND OF THE INVENTION

1. Field of the Invention

The prevent invention relates to an apparatus for folding a cloth, for example, the sleeve cloth for a short-sleeved T-shirt in half while conveying continuously.

2. Description of the Prior Art

An apparatus for folding the sleeve cloth for short-sleeved T-shirt in half, is disclosed in Japanese Laid-open Patent No. 5-31276 (corresponding to U.S. Pat. No. 5,257,591). A conveying device, such as conveyor belt, conveys the cloth continuously along a conveying surface of the conveying device. A holding device mounted on this conveyor belt grips the leading end of the continuously conveyed cloth on the conveying surface of the conveyor belt, lifts the gripped end of the cloth from the conveying surface and holds it above the conveying surface temporarily. When the leading end of the cloth is lifted and held by the holding device, only the rear end of the cloth is conveyed by the conveyor belt. When the rear end of the conveyed cloth reaches a specified position, gripping of the leading end of the cloth is released, and the leading end is overlaid on the rear end. As a result, the cloth is folded in half.

In the conventional apparatus, however, if cloths are mutually overlaid and mounted sequentially on the conveyor belt, the leading end of the cloth of the succeeding side may not be gripped and lifted, or if lifted, the position of the cloth may be largely deviated, and it may fail to fold as specified, and folding errors may occur.

To avoid such defective folding or folding error, the operator must observe the conveying surface of the conveyor belt to wait until the cloth mounted on the conveyor belt reaches a specific position, and put on a next cloth, and therefore when conveying multiple cloths continuously and folding the cloths successively, must spend time in mounting of cloths on the conveyor belt, and the working efficiency is poor on the whole.

SUMMARY OF THE INVENTION

It is hence an object of the invention to present an apparatus for folding a cloth in half capable of enhancing the working efficiency remarkably if cloth sequentially mounted on the conveying surface are mutually overlaid in part.

To achieve the object, an apparatus for folding a cloth conveyed continuously along a conveying surface of a conveying device is provided, said apparatus comprises a first detecting sensor for detecting a leading end of the cloth when the leading end reaches a first specified position, a holding device for gripping the leading end of the cloth by receiving a detection signal from the first detecting sensor, lifting the gripped leading end of the cloth from the conveying surface and holding the gripped leading end above the conveying surface, a second detecting sensor for detecting a rear end of the cloth when the rear end reaches a specified position, while the leading end of the cloth is held above the conveying surface by the holding device, and issuing a signal for releasing gripping to the holding device, a third detecting sensor for detecting the leading end of the cloth when the leading end reaches a second specified position, a cloth stopping device for stopping a front side portion of the cloth temporarily on the conveying surface of the conveying device by receiving a detection signal from the third detecting sensor, the cloth stopping device being disposed at a position of an upstream side in a cloth conveying direction from the holding device, and a blowing device for blowing air toward the cloth when the leading end of the cloth is held above the conveying surface by the holding device, the blowing device being disposed between the cloth stopping device and the holding device.

According to the present invention having such constitution, when the leading end of the cloth mounted on the conveying surface of the conveying device and continuously conveyed along the surface reaches a second specified position, by stopping the front side portion temporarily on the conveying surface, a space is formed between the leading end of the stopped cloth and the rear end of the preceding cloth. Accordingly, if the rear end of the preceding cloth mounted on the conveying surface of the conveying device and the leading end of the succeeding cloth are mutually overlaid, since the leading ends of these cloths can be sequentially gripped and lifted from the conveying surface by the holding device, the cloths being mounted and conveyed continuously can be securely folded in half. Therefore, no wasteful time is spent when mounting the cloths, and the specified folding job can be done very efficiently.

In addition, due to temporary stopping of the front side portion of the cloth on the conveying surface of the conveying device, considering a possibility of forming a bulge at the rear side of the stopped cloth and occurrence of a crease by folding in such state, a blowing device is provided for blowing air toward the cloth while the leading end of the cloth is gripped and lifted from the conveying surface, and the bulge formed in the rear side of the cloth is removed and a crease is not formed, so that the cloth can be folded in half securely and neatly.

Other objects and effects of the invention will be better appreciated from the following description of embodiments.

DESCRIPTION OF THE PREFERRED EMBODIMENTS

Figure 1:
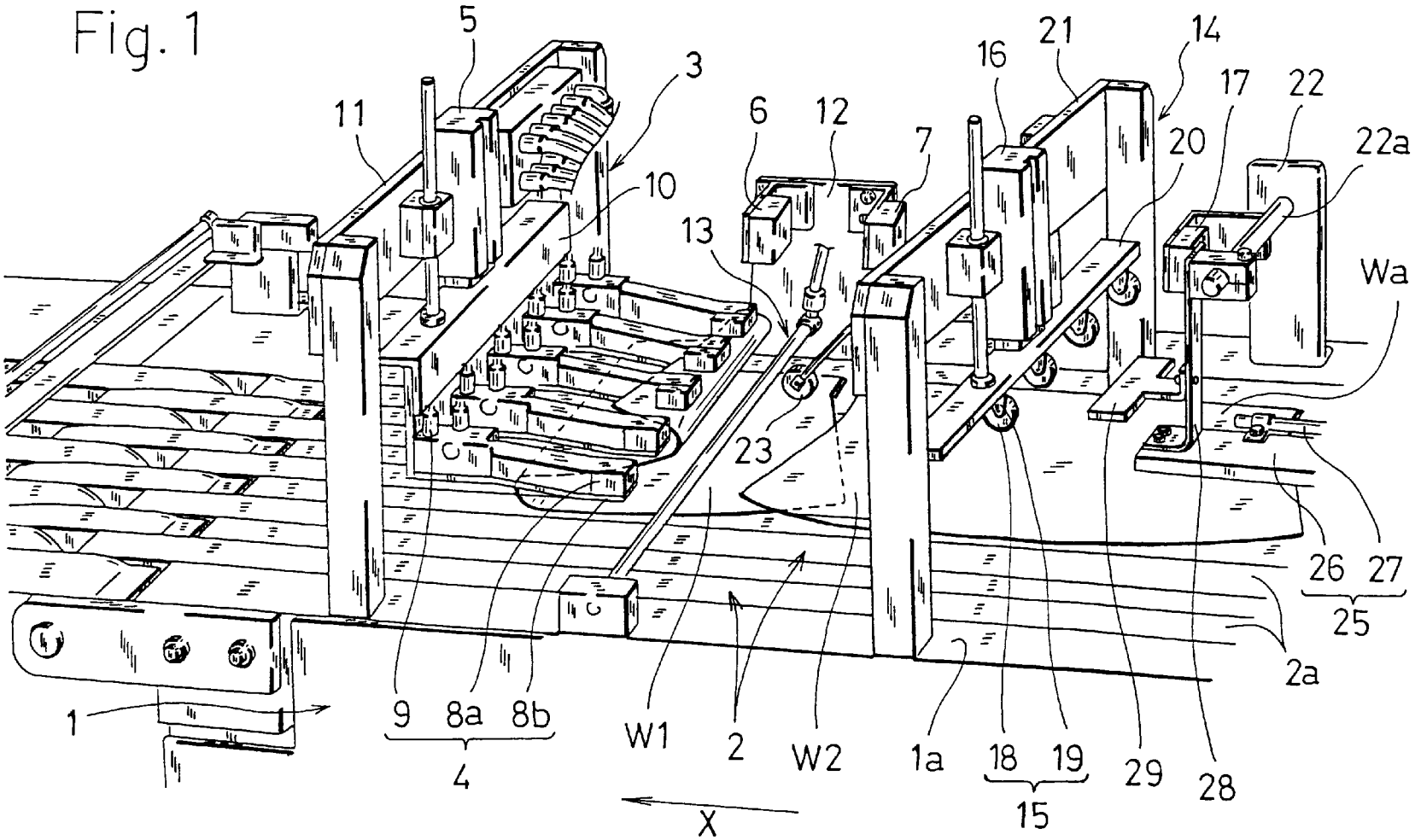
FIG. 1 is an overall perspective view of an apparatus for folding the cloth according to the present invention.

An embodiment of the present invention is described below by referring to the drawings.

FIG. 1 shows an overall view of an apparatus for folding the cloth according to the present invention. A rectangular sewing machine table 1 has a cloth mounting surface 1*a*, and a sewing machine M (see FIG. 5 to FIG. 8) is installed at one side of its longitudinal side. On the cloth mounting surface 1*a* of the sewing machine table 1, a plurality of narrow conveyor belts 2 are disposed parallel almost in an overall length as cloth conveying means for conveying the cloth in the direction of arrow X. The plurality of narrow conveyor belts 2 are driven at constant speed, and are disposed parallel at predetermined intervals in the direction orthogonal to the cloth conveying direction of the sewing machine M. The conveyor belts 2 have a conveying surface 2*a* almost flush with the sewing machine table 1.

Above the conveying surface 2*a* of the narrow conveyor belts 2 at the downstream side in the cloth conveying direction X from the sewing machine M, a cloth end holding device 3 is installed for gripping the leading end of the cloth, lifting the gripped leading end of the cloth from the conveying surface 2*a* and holding it above the conveying surface 2*a* temporarily. The cloth end holding device 3, as shown in FIG. 1, composes a cloth clamp 4 for gripping or releasing the leading end of the cloth, and an elevating air cylinder 5 for moving up and down the entire of the cloth clamp 4 between the position adjacent to the conveying surface 2*a* of the narrow conveyor belts 2 and the position spacing upward.

At the upstream side in the cloth conveying direction X of the cloth end holding device 3, a first cloth leading end detecting sensor 6 (first detecting sensor) for detecting the leading end of the cloth conveyed by the narrow conveyor belts 2, and a cloth rear end detecting sensor 7 (second detecting sensor) for detecting the rear end of the cloth are disposed.

The cloth clamp 4 is composed of a pair of upper and lower gripping pieces 8*a*, 8*b* positioned between the narrow conveyor belts 2, and an opening air cylinder 9 for opening and closing the pair of gripping pieces 8*a*, 8*b* in the vertical direction, and these members 8*a*, 8*b*, 9 are mounted on a nearly L-shaped support frame 10. Of the pair of upper and lower gripping pieces 8*a*, 8*b*, the lower gripping piece 8*b* is formed in an inclined state so that its leading end may be nearly flush with the conveying surface 2*a* of the narrow conveyor belts 2 and positioned upward as going toward the base end when the cloth clamp 4 is lowered to the adjacent position.

The elevating air cylinder 5 is fixed in the center of a portal frame 11 set up on the sewing machine table 1, and the support frame 10 of the cloth clamp 4 is fixed at the lower end of the piston rod of this elevating air cylinder 5. The cloth leading end detecting sensor 6 and cloth rear end detecting sensor 7 are mounted on a bracket 12 across a space upstream and downstream in the cloth feed direction, and positioned above the cloth mounting surface 1*a* adjacent to the cloth feed-in side of the cloth clamp 4.

The both detecting sensors 6, 7 detect whether cloth conveyed by the narrow conveyor belts 2 is at the upstream side of the cloth clamp 4 or not, and issue detection signals. An air blowing pipe 13 as blowing device is disposed at a downward position of both sensors 6, 7 across a space, that is, at an oblique downward position at the upstream side in the cloth conveying direction from the cloth clamp 4 at a position spaced from the narrow conveyor belts 2. The air blowing pipe 13 blows air toward the cloth gripped by the cloth clamp 4 and lifted from the conveying surface 2*a*.

Figure 2:
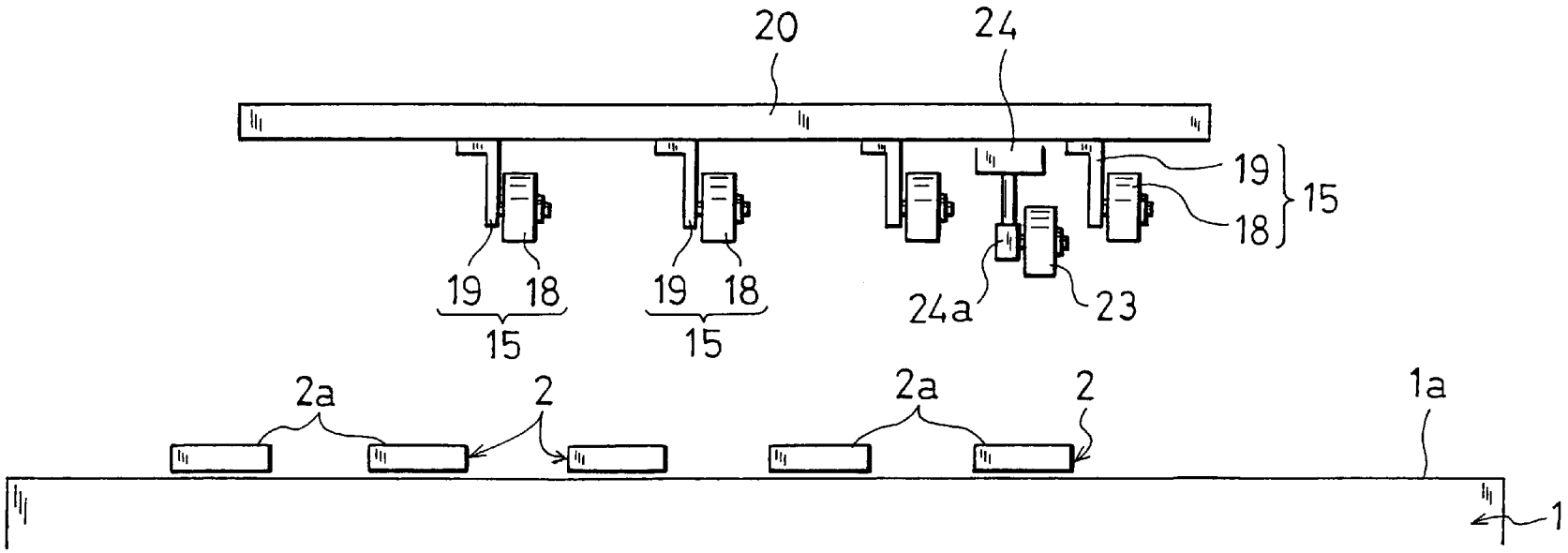
FIG. 2 is a longitudinal front view of essential parts of a cloth stopping device in the apparatus.

Above the conveying surface 2*a* of the narrow conveyor belts 2 between the air blowing pipe 13 and sewing machine M, a cloth stopping device 14 is disposed above the conveying surface 2*a* for temporarily stopping the front side portion of the conveyed cloth. The cloth stopping device 14 is composed of a cloth pressing guide 15 positioned between the narrow conveyor belts 2 for pressing the middle of the cloth to the sewing machine table 1, and an elevating air cylinder 16 for moving this cloth pressing guide 15 up or down between the action position for pressing against the sewing machine table 1 and the non-action position departing upward. This action is executed by a third cloth leading end detecting sensor 17 (third detecting sensor) for detecting the leading end of the cloth conveyed by the narrow conveyor belts 2. The cloth pressing guide 15 includes, as shown in FIG. 2, a cloth pressing roller 18 positioned between the narrow conveyor belts 2, and a support piece 19 for rotatably supporting the cloth pressing roller 18 about the axial center orthogonal to the cloth conveying direction, and the support piece 19 is mounted on a support frame 20. The elevating air cylinder 16 is fixed to the center of a portal frame 21 set up on the sewing machine table 1, and the support frame 20 of the cloth pressing guide 15 is fixed at the lower end of the piston rod of this elevating air cylinder 16.

The third cloth leading end detecting sensor 17 in the cloth stopping device 14 is mounted on a bracket 22, and is disposed above the cloth mounting surface 2*a* at a position of the upstream side in the cloth conveying direction from the cloth pressing guide 15. The third cloth leading end detecting sensor 17 detects whether the cloth conveyed on the narrow conveyor belts 2 is at the cloth mounting surface 1*a* or not, and issues its detection signal.

In FIG. 1, reference numeral 23 is a roller to be engaged with the rear end side (lower sleeve edge Wa) of the cloth when the leading end of the cloth is lifted from the conveying surface 2*a* by the cloth end holding device 3, and it is a cloth guide member for conveying and guiding the cloth along the conveying surface 2*a*. This roller is disposed oppositely to the narrow conveyor belts 2 as shown in FIG. 2.

The roller 23 is rotatably supported about the axial center orthogonal to the cloth conveying direction at the leading end of a movable piston rod 24*a* of an elevating cylinder 24, and its rotating direction is along the cloth conveying direction X. The elevating cylinder 24 is mounted on the portal frame 21 above the conveying surface 2*a*, and is in an inclined position toward an obliquely downward side at the downstream side in the cloth conveying direction X.

Above the conveying surface 2*a* of the narrow conveyor belts 2 adjacent to the sewing machine M, a guide device 25 is disposed for guiding the cloth sent out from the sewing machine M from above. The guide device 25 is, as shown in FIG. 1, composed of a guide plate 26 for guiding the portion adjacent to the lower sleeve edge Wa of the sleeve cloth, and an air blow pipe 27 for blowing air toward the lower sleeve edge Wa from above. The guide plate 26 is attached to a bar 22*a* projecting from the bracket 22 through an L-shaped frame 28, and is designed to flatten the cloth conveyed by the narrow conveyor belts 2. The air blow pipe 27 is extended from an end of the guide plate 26, and blows air toward the lower sleeve edge Wa positioned beneath the extension to flatten the lower sleeve edge Wa of the sleeve cloth.

Figure 3:
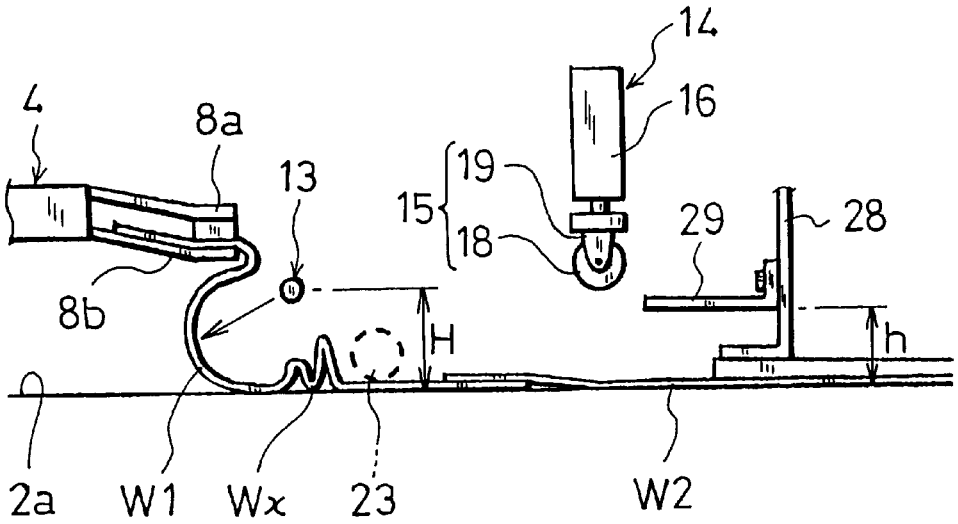
FIG. 3 is a schematic side view explaining essential constitution and first action state of the apparatus.
Figure 4:
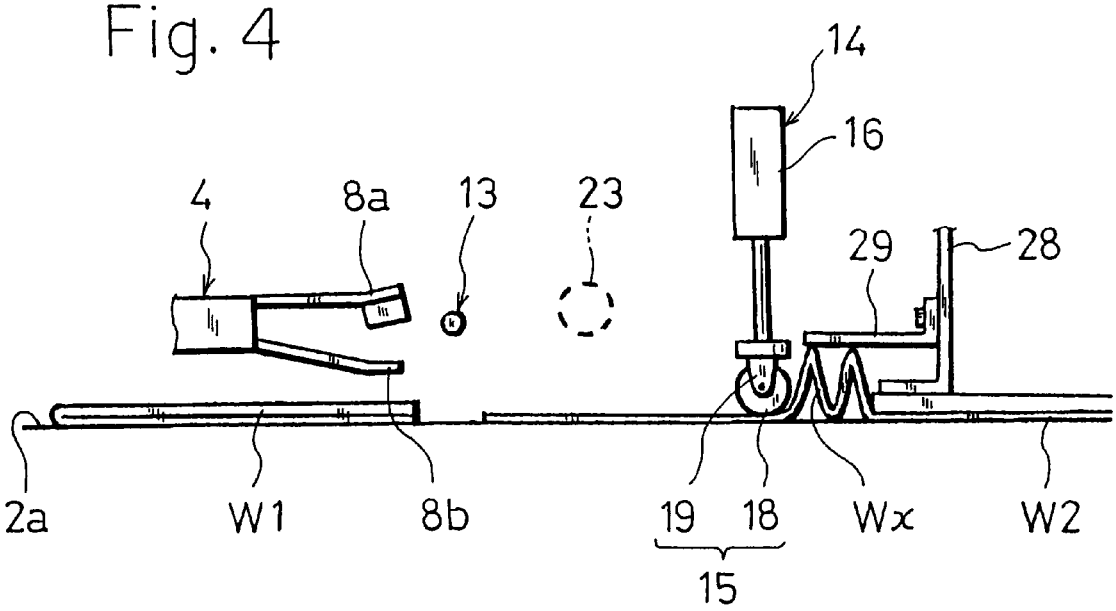
FIG. 4 is a schematic side view explaining essential constitution and second action state of the apparatus.

Further, above the cloth mounting surface 1*a* adjacent to the upstream side in the cloth conveying direction X of the cloth stopping device 14, a bulge defining plate 29 is disposed for defining the height of a bulge Wx formed at the rear side of the cloth when the front side portion of the cloth is stopped temporarily on the conveying surface 2*a*. This defining plate 29 is, as shown in FIG. 3 and FIG. 4, to define so that the highest portion of the bulge Wx of the cloth may be lower than the height of installation of the air blowing pipe 13, and it is fitted to the L-shaped frame 28, and its mounting height h is set smaller than the space H between the sewing machine table 1 and the air blowing pipe 13.

Thus, by forming the bulge defining plate 29, smooth conveying of the cloth is assured without allowing the bulge Wx of the cloth formed due to temporary stopping of the leading end of the cloth to contact with the air blowing pipe 13, and the cloth bulge Wx can be removed securely by air blow.

Figure 7:
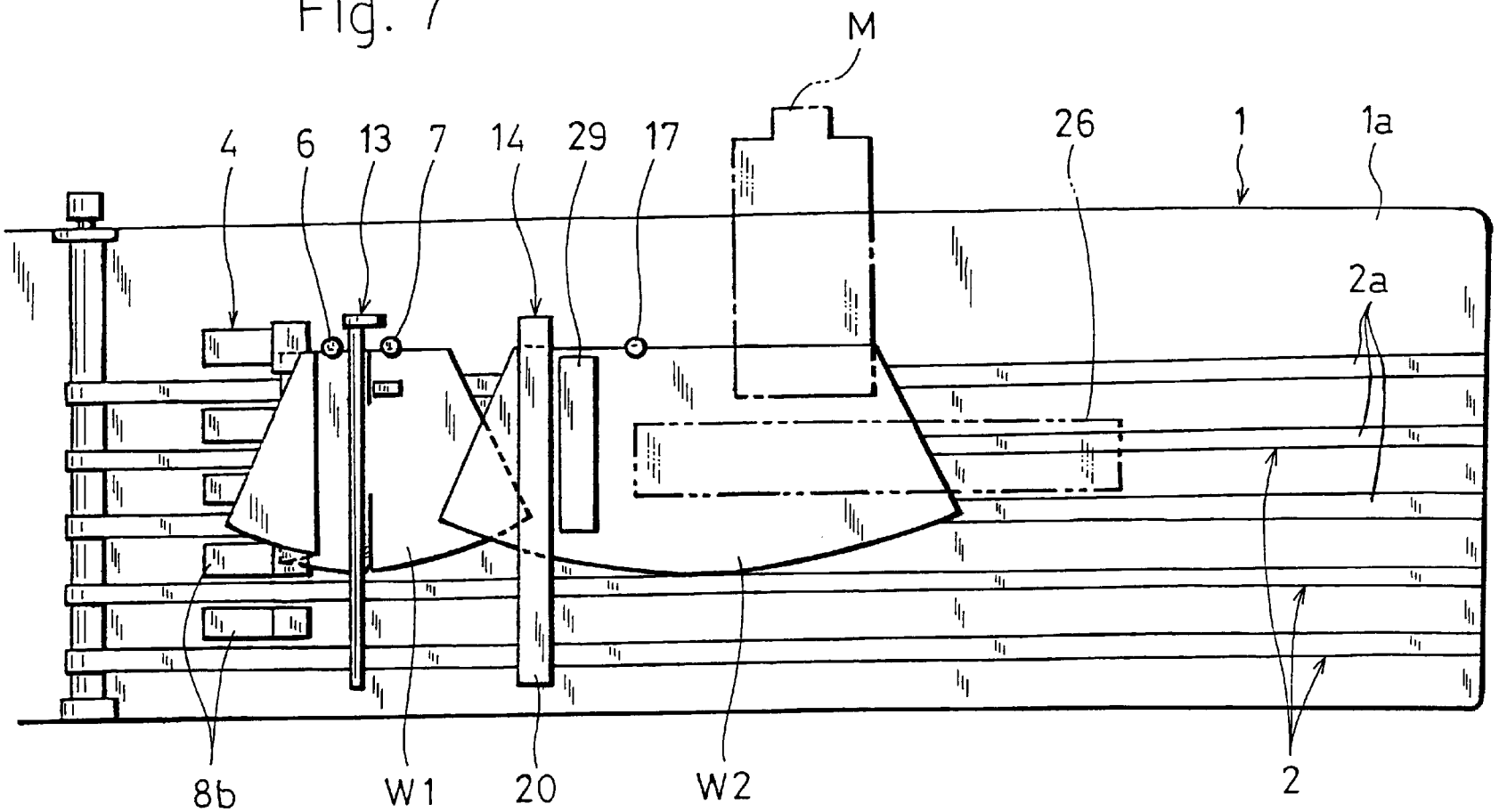
FIG. 7 is a schematic plan view of essential parts explaining third action state of the cloth folding operation by the apparatus.
Figure 8:
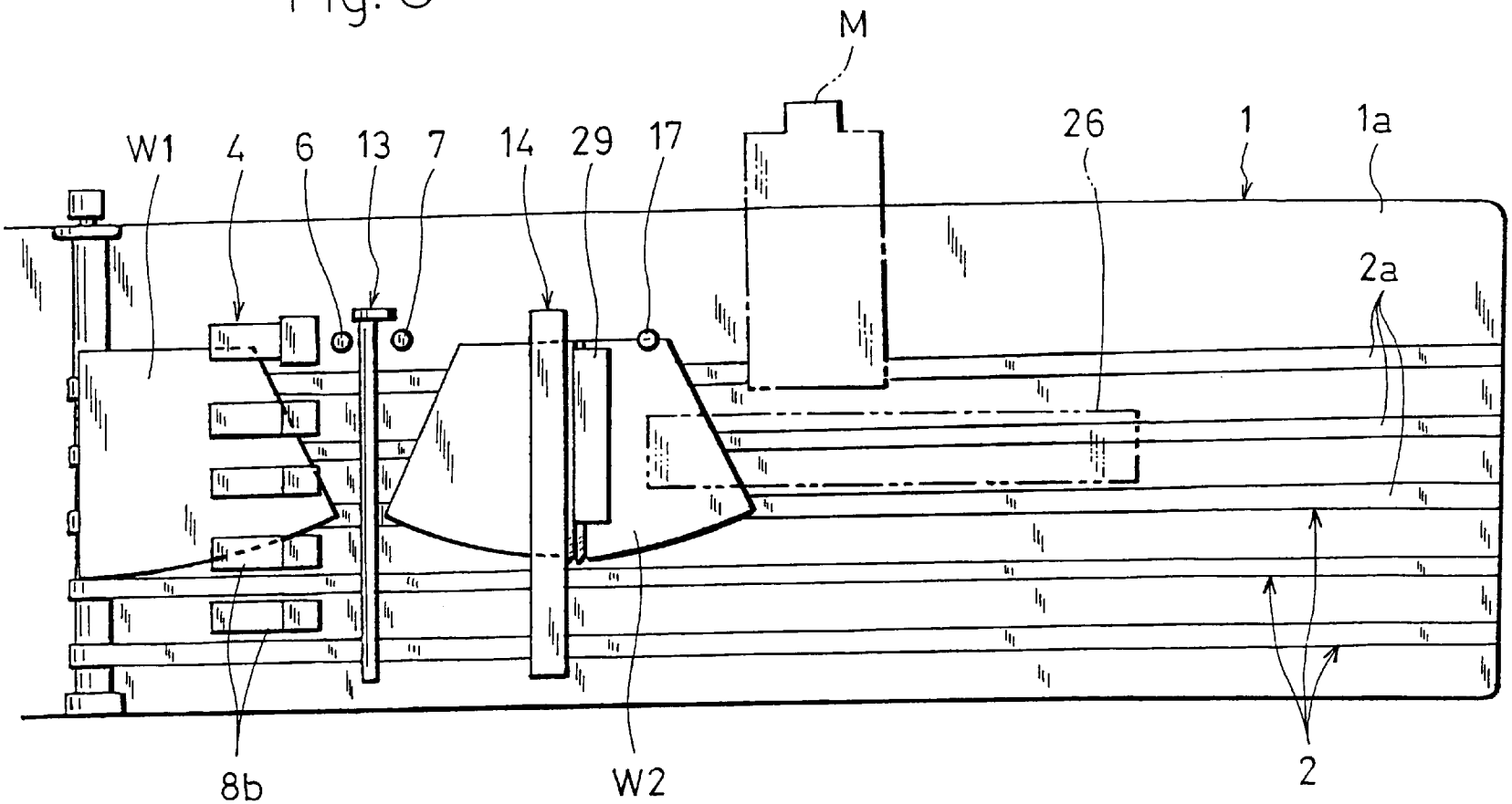
FIG. 8 is a schematic plan view of essential parts explaining fourth action state of the cloth folding operation by the apparatus.
Figure 9:
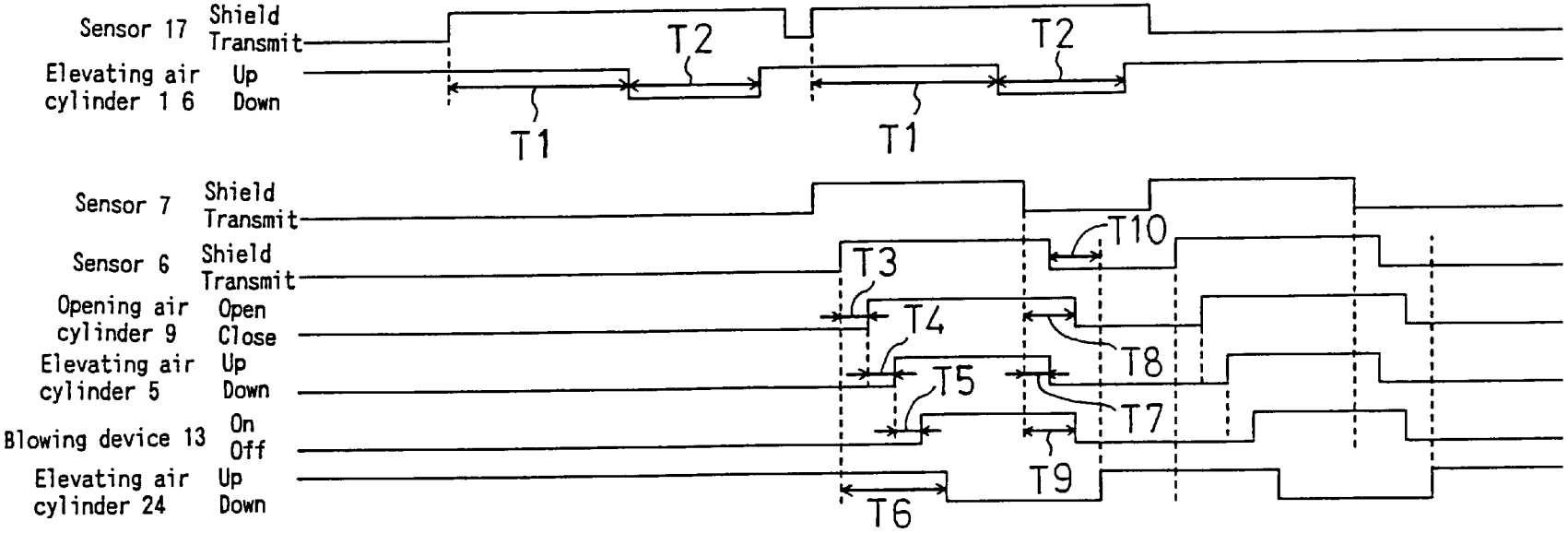
FIG. 9 is a timing chart explaining cloth folding action by the apparatus.

Using the apparatus in this constitution, the operation for folding the cut fabric for sleeve is explained while referring to FIG. 5 to FIG. 8 and timing chart in FIG. 9.

Figure 5:
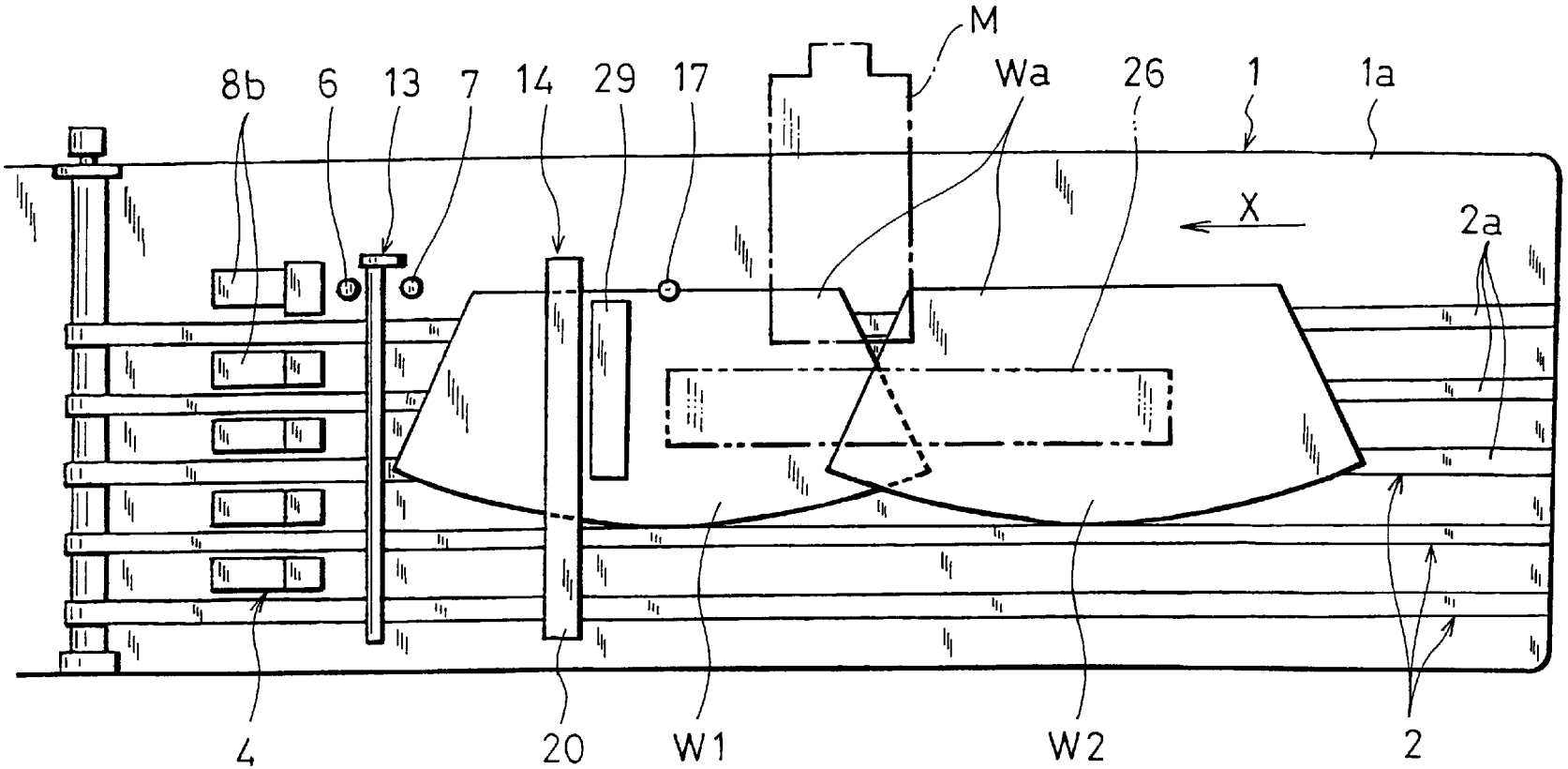
FIG. 5 is a schematic plan view of essential parts explaining first action state of the cloth folding operation by the apparatus.
Figure 6:
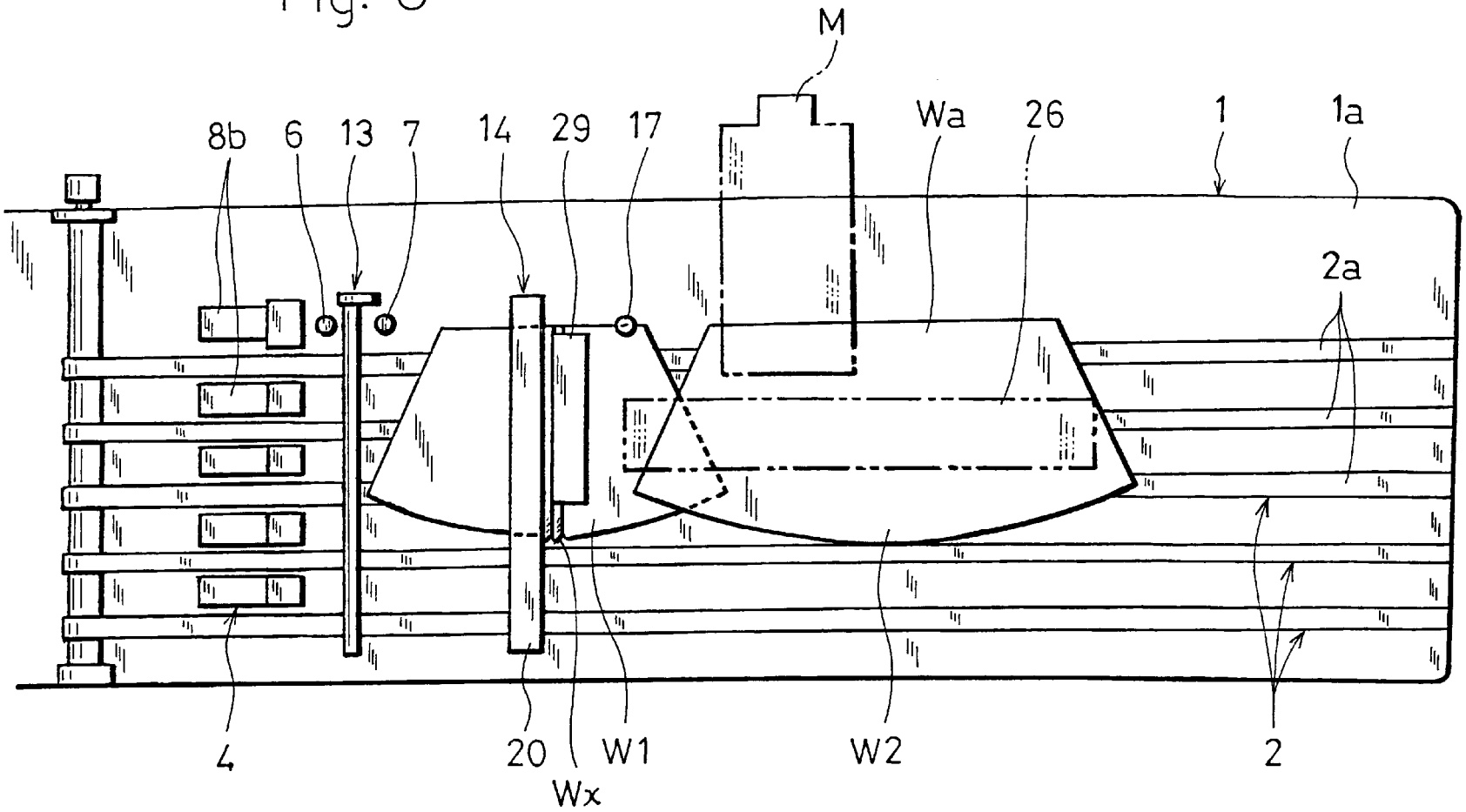
FIG. 6 is a schematic plan view of essential parts explaining second action state of the cloth folding operation by the apparatus.

As shown in FIG. 5, two sleeve cloths W1, W1 put on the conveying surface 2*a* so that the lower sleeves edges Wa may not be overlaid each other are conveyed in the direction of arrow x by the narrow conveyor belts 2, and pass through the sewing machine M, and are sewn sequentially. When the leading end of the lower sleeve edge Wa side of the preceding cloth W1 sewn by the sewing machine M is detected by the third cloth leading end detecting sensor 17, receiving this detection signal, the cloth stopping device 14 is moved to the position for pushing to the sewing machine table 1. The front side portion of the preceding cloth W1 is stopped in the conveying surface 2*a*. In the timing chart shown in FIG. 9, in a set time T1 after detection of the leading end of the lower sleeve edge Wa of the cloth W1 by the sensor 17, the elevating air cylinder 16 is operated, and the cloth pressing guide 15 is lowered to the position for pressing to the sewing machine table 1. By this pressing of the cloth pressing guide 15, the front side portion of the cloth W1 is stopped for a set time T2, and a bulge Wx is formed in the cloth W1 at the upstream side of the pressing portion. The highest portion of the bulge Wx of the cloth W1 is defined to be lower than the height of installation of the air blowing pipe 13 by the bulge defining plate 29 (see FIG. 4).

Consequently, when the leading end of the lower sleeve edge Wa side of the preceding cloth W1 is detected by the first cloth leading end detecting sensor 6, the cloth clamp 4 in the cloth end holding device 3 is actuated, and the leading end of the cloth W1 is gripped, and the gripped leading end is lifted and held at a position remote from the conveying surface 2*a* of the narrow conveyor belts 2. In the timing chart shown in FIG. 9, in a set time T3 after detection of the leading end of the lower sleeve edge Wa side of the preceding cloth W1 by the sensor 6, the opening air cylinder 9 is actuated, and the pair of gripping pieces 8*a*, 8*b* are closed. In a set time T4 after actuation of the opening air cylinder 9, the elevating air cylinder 5 is actuated, and the cloth clamp 4 is raised to a position remote from the conveying surface 2*a*.

In this way, in a lifted and held state of the leading end of the cloth W1, the parts other than the leading end of the cloth W1 are conveyed in the direction of arrow X by the narrow conveyor belts 2, and operation of the air blowing pipe 13 is started, and by blowing air toward the upper surface of the cloth W1, the bulge Wx formed on the cloth W1 is removed. In the timing chart shown in FIG. 9, in a set time T5 after actuation of the elevating air cylinder 5, operation of the air blowing pipe 13 is started, and the air is blown toward the upper surface of the lifted cloth W1. At this time, the leading end of the lower sleeve edge Wa side of the succeeding cloth W2 passes through the sewing machine M as shown in FIG. 7, and has been already detected by the third cloth leading end detecting sensor 17.

After detection of the leading end of the lower sleeve edge Wa side of the preceding cloth W1, as shown in FIG. 3, the roller 23 as the cloth guide member is engaged with the lower sleeve edge Wa of the cloth W1, and guides the cloth W1 along the conveying surface 2*a*. In the timing chart shown in FIG. 9, in a set time T6 after detection of the leading end of the lower sleeve edge Wa side of the preceding cloth W1 by the sensor 6, that is, after the bulge Wx of the cloth W1 has passed the lower side of the air blowing pipe 13, the elevating air cylinder 24 is actuated, and the roller 23 is engaged with the lower sleeve edge Wa of the cloth W1. In this way, by blowing air toward the cloth W1 from the air blowing pipe 13 while the roller 23 guides the cloth W1 along the conveying surface 2*a*, the bulge Wx formed on the cloth W1 is securely removed.

In consequence, after detection of the rear end of the lower sleeve edge Wa side of the preceding cloth W1 by the sensor 7, the cloth clamp 4 is actuated to lower to a position adjacent to the conveying surface 2*a* of the narrow conveyor belts 2, and gripping of the leading end of the cloth W1 is released, and air blow to the cloth W1 by the air blowing pipe 13 is stopped, and the cloth W1 is folded in half. In the timing chart shown in FIG. 9, in a set time T7 after detection of the rear end of the lower sleeve edge Wa side of the cloth W1 by the sensor 7, the elevating air cylinder 5 is actuated to lower the cloth clamp 4 to a position adjacent to the conveying surface 2*a*, and in a set time T8, the opening air cylinder 9 is actuated to open the pair of gripping pieces 8*a*, 8*b*. In a set time T9, the operation of the air blowing pipe 13 is stopped. Herein, the descending speed of the elevating air cylinder 5 operating after the set time T7 is set so as not to disturb conveying of the cloth W1 due to contact of the leading end of the lower gripping piece 8*b* with the cloth W1 folded in half.

After detection of the rear end of the lower sleeve edge Wa side of the preceding cloth W1 by the sensor 6, engagement of the roller 23 with the lower sleeve edge Wa of the cloth W1 is cleared. In the timing chart shown in FIG. 9, in a set time T10 after detection of the rear end of the lower sleeve edge Wa side of the cloth W1 by the sensor 6, the elevating air cylinder 24 is actuated, and the roller 23 is spaced above from the lower sleeve edge Wa of the cloth W1 as shown in FIG. 4.

When the leading end of the succeeding cloth W2 conveyed consecutively to the preceding cloth W1 is detected by the third cloth leading end detecting sensor 17, the cloth stopping device 14 is moved to the position for pressing against the sewing machine table 1, and the front side portion of the succeeding cloth W2 is stopped on the conveying surface 2*a*. In the timing chart shown in FIG. 9, in a set time T1 after detection of the leading end of the lower sleeve edge Wa side of the succeeding cloth W2 by the sensor 17, the elevating air cylinder 16 is actuated, and the cloth pressing guide 15 is lowered to the position for pressing against the sewing machine table 1, and by this descent of the cloth pressing guide 15, the downstream side of the cloth stopping device 14, that is, the front side portion of the succeeding cloth W2 is stopped for a set time T2, and a bulge Wx same as mentioned above is formed in the cloth W2 of the upstream side of the pressing part. By this stopping of the front side portion of the succeeding cloth W2, as shown in FIG. 8, a space is formed between the preceding cloth W1 and the succeeding cloth W2 enough for keeping the lower gripping piece 8*b* of the cloth clamp 4.

In such sequential operation, if two sleeve cloths W1, W2 are conveyed on the conveying surface 2*a* so that the lower sleeve edges W1 may not overlay each other while other parts may overlay mutually, by temporarily stopping the front side portions on the conveying surface 2*a*, it is possible to form a space between the rear end of the preceding cloth W1 and the leading end of the succeeding cloth W2. Therefore, by gripping the leading ends of the both cloths W1, W2 securely by the cloth end holding device 3 sequentially, and lifting from the conveying surface 2*a* and holding it above the conveying surface 2*a* temporarily, the cloth can be folded in half securely.

In the embodiment, two sleeve cloths W1, W2 are put on the cloth mounting surface 1*a* of the sewing machine table 1, but as far as the mounting condition is the same, that is, the lower sleeve edges W1 are not overlaid mutually, three or more cloths can be similarly folded in half securely.

The entire disclosure of Japanese Patent Application No. 9-257098 filed on Sep. 22, 1997, including the specification, claims, drawings and summary are incorporated herein by reference in its entirety.

What is claimed is:

1. An apparatus for folding a cloth conveyed continuously along a conveying surface of a conveying device, said apparatus comprising:

a first detecting sensor for detecting a leading end of the cloth when the leading end reaches a first specified position, a holding device for gripping the leading end of the cloth by receiving a detection signal from the first detecting sensor, lifting the gripped leading end of the cloth from the conveying surface and holding the gripped leading end above the conveying surface, a second detecting sensor for detecting a rear end of the cloth when the rear end reaches a specified position, while the leading end of the cloth is held above the conveying surface by the holding device, and issuing a signal for releasing gripping to the holding device, a third detecting sensor for detecting the leading end of the cloth when the leading end reaches a second specified position, a cloth stopping device for stopping a front side portion of the cloth temporarily on the conveying surface of the conveying device by receiving a detection signal from the third detecting sensor, the cloth stopping device being disposed at a position of an upstream side in a cloth conveying direction from the holding device, and a blowing device for blowing air toward the cloth when the leading end of the cloth is held above the conveying surface by the holding device, the blowing device being disposed between the cloth stopping device and the holding device.

2. An apparatus of claim 1, said apparatus further comprising a bulge defining plate for defining a highest portion of a bulge of the cloth formed due to temporary stopping of the front side portion of the cloth on the conveying surface, the bulge defining plate being disposed at a position adjacent to the upstream side in the cloth conveying direction of the cloth stopping device and at a position lower than a height of installation of the blowing device.

3. An apparatus of claim 1, said apparatus further comprising a cloth guide member for guiding the cloth along the conveying surface of the conveying device by engaging with the rear end of the cloth when the blowing device blows air.

* * * * *